US012201206B2

(12) United States Patent
Jourdain et al.

(10) Patent No.: US 12,201,206 B2
(45) Date of Patent: Jan. 21, 2025

(54) DEVICE FOR APPLYING A COSMETIC PRODUCT STICK

(71) Applicant: ALBEA SERVICES, Gennevilliers (FR)

(72) Inventors: Marc Jourdain, Gennevilliers (FR); Mark Edmondson, Gennevilliers (FR); Thomas Emmanuel Sourdeau, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 18/202,782

(22) Filed: May 26, 2023

(65) Prior Publication Data

US 2023/0380574 A1 Nov. 30, 2023

(30) Foreign Application Priority Data

May 31, 2022 (FR) ..... 2205227

(51) Int. Cl.
*A45D 40/06* (2006.01)
*A45D 40/00* (2006.01)
*A45D 40/04* (2006.01)

(52) U.S. Cl.
CPC ..... *A45D 40/06* (2013.01); *A45D 40/04* (2013.01); *A45D 2040/0062* (2013.01)

(58) Field of Classification Search
CPC ..... A45D 40/06; A45D 40/04; A45D 2040/0062; A45D 40/00; A45D 40/205; A45D 2040/208; A45D 40/20
USPC ..... 401/68, 75, 77, 78, 88, 87
See application file for complete search history.

(56) References Cited

U.S. PATENT DOCUMENTS 2,284,162 A 5/1942 Mcknight et al.
2,504,490 A 4/1950 William et al.
2,921,675 A * 1/1960 Clark ..... A45D 40/06 401/98
3,124,245 A 3/1964 Croan
4,108,558 A * 8/1978 Radice ..... A45D 40/06 401/78
4,750,501 A 6/1988 Ackermann et al.
(Continued)

FOREIGN PATENT DOCUMENTS

DE 102019107890 A1 10/2020
GB 2088333 A 6/1982
(Continued)

OTHER PUBLICATIONS

Application No. FR 2205227, "Search Report," mailed Dec. 22, 2022, 12 pages (No English translation available. A summary of the Search Report is provided in the Transmittal Letter submitted herewith.).
(Continued)

*Primary Examiner* — David J Walczak
(74) *Attorney, Agent, or Firm* — Kilpatrick Townsend & Stockton LLP

(57) ABSTRACT

A device for applying a cosmetic product includes a cup comprising at least one lug; a guide comprising a slot passed through by an associated lug of the cup, the slot comprising an upper edge; a sheath comprising internally a helical groove for receiving the lug of the cup; and the lug (32) having an upper flattened area. The upper edge of the slot is inclined with respect to a radial plane.

17 Claims, 7 Drawing Sheets

(56) References Cited

U.S. PATENT DOCUMENTS

| | | | | |
|---|---|---|---|---|
| 4,813,801 | A | 3/1989 | Cardia | |
| 5,746,530 | A | 5/1998 | Oota | |
| 5,865,550 | A * | 2/1999 | Bouix | A45D 40/06 401/86 |
| 6,116,802 | A | 9/2000 | Gueret | |
| 6,375,375 | B1 | 4/2002 | Gebb et al. | |
| 7,422,387 | B2 | 9/2008 | Kurihara et al. | |
| 10,874,193 | B2 | 12/2020 | Chen et al. | |
| 11,737,548 | B2 | 8/2023 | Mueller | |
| 2003/0068187 | A1 * | 4/2003 | Holloway | A45D 40/12 401/78 |
| 2006/0056902 | A1 * | 3/2006 | Susini | A45D 40/06 401/78 |
| 2008/0025785 | A1 * | 1/2008 | Ma | A45D 40/06 401/75 |
| 2015/0164202 | A1 | 6/2015 | Zhu et al. | |

FOREIGN PATENT DOCUMENTS

| | | | |
|---|---|---|---|
| KR | 102005321 | B1 | 7/2019 |
| KR | 20210009818 | A | 1/2021 |
| WO | 9523747 | A1 | 9/1995 |

OTHER PUBLICATIONS

U.S. Appl. No. 18/202,785, "Non-Final Office Action", May 7, 2024, 13 pages.

EP23176240.2, "Extended European Search Report and Written Opinion", Oct. 24, 2023, 24 pages.

* cited by examiner

DEVICE FOR APPLYING A COSMETIC PRODUCT STICK

REFERENCE TO RELATED APPLICATION

This application is based on and claims the benefit of priority from French Patent Application No. 2205227, filed on May 31, 2022, the content of which is incorporated by reference in its entirety.

TECHNICAL FIELD OF THE INVENTION

The invention relates to a device for applying a cosmetic product, in particular a cosmetic product stick, said device comprising:

- a cup intended to receive the stick and comprising at least one radial lug;
- at least one guide comprising a tubular body which comprises an upper opening for getting the stick out, in which the cup is mounted so as to slide axially, the guide comprising at least one slot through which the at least one associated lug of the cup passes, the slot being delimited axially towards the opening by an upper edge;
- a tubular sheath in which the body is mounted in rotation, the sheath comprising internally at least one helical groove for receiving the at least one lug of the cup, the rotation of the guide with respect to the sheath causing an axial movement of the cup between an extreme extended position through the opening in which the lug is in abutment against the upper edge of the slot and an extreme retracted position;
- the at least one lug has an upper flattened area.

TECHNICAL BACKGROUND

Devices of this type are known from the prior art for packaging a cosmetic product, such as a cosmetic stick, in particular but not exclusively for a lipstick. Such a cosmetic product stick will be referred to hereinafter and in the claims as "stick".

The stick is held by its base in a cup that slides axially between at least one retracted position and an application position of the cosmetic product in which at least one portion of the cosmetic product stick extends axially out of the device.

In a known way, such a kinematics is obtained thanks to a rotary mechanism comprising a guide and a sheath which, mounted concentrically, comprise for the one at least one slide and for the other at least one helical groove which are respectively passed through radially by at least one lug secured to the cup carrying the stick.

The cup generally comprises a pair of lugs, the two lugs being arranged diametrically opposite each other, the guide being equipped with two slides and the sheath with two helical grooves.

The actuation of the mechanism is generally controlled manually by applying a rotational movement to the base of the device, which rotational movement is transmitted to the mechanism to cause the axial displacement of the cup comprising the cosmetic product.

One method of arranging the stick in the cup consist in first assembling the various components of the device, except for the cover, and then positioning the cup in its extreme extended position. The stick, previously moulded, is then forced into the cup. The cup comprises ribs that penetrate the sticks to hold them in place. The cup is then slid into the extreme retracted position and the device is equipped with its cover.

To carry out the operation of inserting the stick, the base of the device is generally positioned and held on a support, while a sliding element carrying the stick is lowered axially relative to the support to allow the insertion of the stick into the cup. The final position of the sliding element at the end of the insertion operation is determined in relation to the position of the support.

It is therefore necessary that the bottom of the cup, in the extreme extended position, is positioned very precisely in relation to the base of the device. In particular, it is necessary that the positioning tolerance of the cup in relation to a reference position is very small, for example less than or equal to 0.2 mm. In the field of cosmetic products, great importance is indeed given to the quality and aesthetics of the product.

If the bottom of the cup is too high, the stick may be crushed against the bottom, resulting in its deformation.

On the other hand, if the cup is too low, the stick may not be pushed into the cup sufficiently. The stick may then wobble in the cup and touch the edges of the guide. This would again result in damage to the stick.

It is therefore necessary that the cup is held stably in its extreme extended position. In addition, it is also necessary to position the cup precisely in height in relation to the base.

SUMMARY OF THE INVENTION

The invention proposes a device for applying a cosmetic product, in particular a cosmetic product stick, said device comprising:

- a cup intended to receive the stick and comprising at least one radial lug;
- at least one guide comprising a tubular body which comprises an upper opening for getting the stick out, in which the cup is mounted so as to slide axially, the guide comprising at least one axial slot extending from the bottom of the guide which is passed through by the at least one associated lug of the cup, the slot being delimited by a rectilinear upper edge;
- a tubular sheath in which the body is mounted in rotation, the sheath comprising internally at least one helical groove for receiving the at least one lug of the cup, the rotation of the guide with respect to the sheath causing an axial movement of the cup between an extreme extended position through the opening in which the lug is in abutment against the upper edge of the slot and an extreme retracted position;
- the at least one lug has an upper flattened area.

The application device according to the invention is characterised in that the upper edge of the at least one slot is inclined with respect to a radial plane.

According to another aspect of the invention, the helical groove has a constant angle of inclination, the upper flattened area of the lug having the same angle of inclination as the helical groove and cooperating with an upper wall of said helical groove, the upper edge of the at least one slot having the same angle of inclination as the upper flattened area of the lug so that, in the extreme extended position, the lug bears against the upper edge over the entire width of the upper flattened area.

According to another aspect of the invention, the at least one slot has an upper end stretch which has a width substantially equal to the width of the lug, the lug being housed in said end stretch of the at least one slot in the extreme extended position of the cup.

According to another aspect of the invention, the at least one slot has a passage restriction arranged at the lower entrance of the upper end stretch of said slot.

According to another aspect of the invention, the at least one slot is delimited in the width orientation by two axial edges, the restriction of passage being made by at least one projection made in the one and/or the other of the axial edges.

According to another aspect of the invention, the at least one slot is axially open in a direction opposite to the opening.

According to another aspect of the invention, the passage of the lug through the passage restriction is achieved by elastically spacing apart the axial edges of the at least one slot.

According to another aspect of the invention, when the cup occupies its extreme extended position, the lug is axially tightened between the upper edge of the at least one slot and the projection under the effect of the elastic return force of the axial edges, the cup thus being blocked in its extreme extended position as long as an axial force greater than a force for overcoming the passage restriction is not applied to the cup.

In a further aspect of the invention, the lug comprises a lower flattened area parallel to the upper flattened area, the lower flattened area cooperating with a lower wall of the associated helical groove of the sheath.

According to another aspect of the invention, the sheath, the guide, and the cup are made of polypropylene.

In another aspect of the invention, the sheath forms a base of the device to which a removable cover is intended to be directly attached.

BRIEF DESCRIPTION OF THE FIGURES

Further characteristics and advantages of the invention will become apparent from the following detailed description, for the understanding of which reference is made to the attached drawings briefly described below.

DETAILED DESCRIPTION OF THE INVENTION

Figure 1:
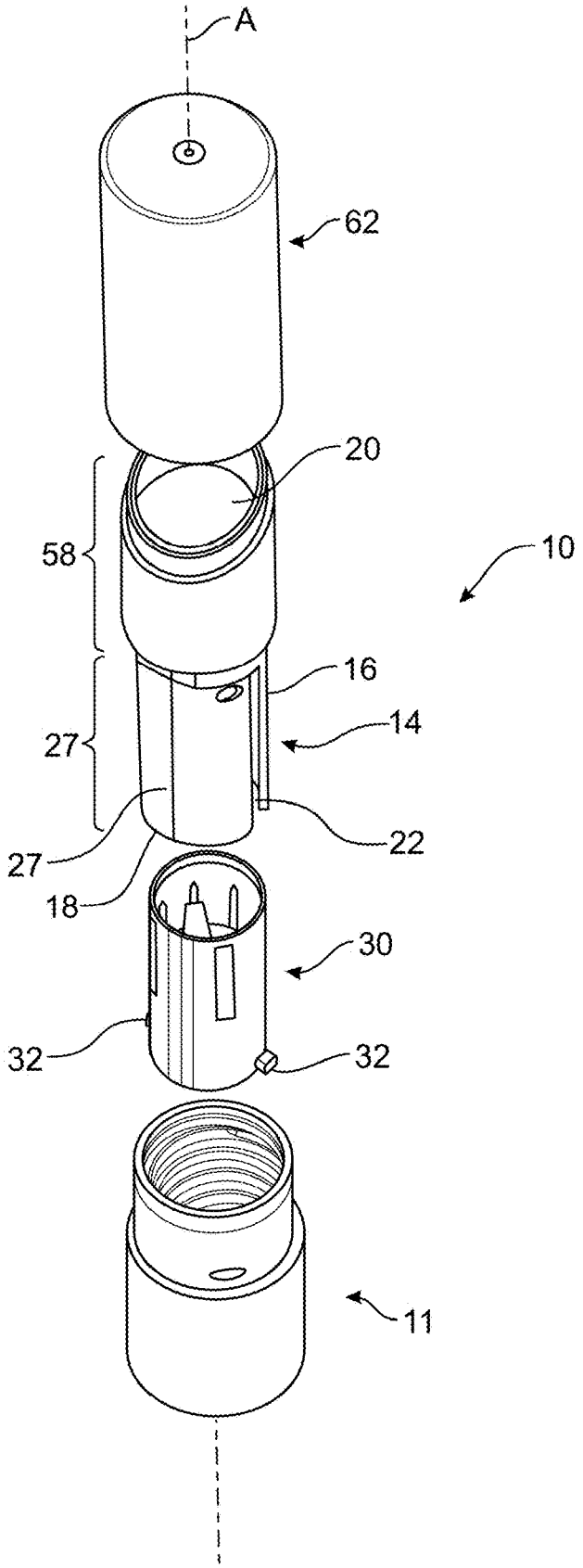
FIG. 1 is an exploded perspective view showing a cosmetic product application device made according to the teachings of the invention.

By convention, the "axial" direction in the figures corresponds to that of the main axis A of the device (also referred to as mechanism) for applying a cosmetic product, such as a cosmetic product stick, in particular a lipstick, and the "radial" direction is directed orthogonally to the axial direction, radiating from the main axis.

A plane orthogonal to the axis "A" will be referred to as a "radial plane" in the following description and in the claims.

In the following detailed description of the figures, the terms "upper" and "lower" or "top" and "bottom" will be used in reference to the axial direction, the upper portion of the device corresponding to that through which the stick of cosmetic product get out of the device for its application.

Similarly, the terms "outer or external" and "inner or internal" are used with reference to the radial direction, an outer element being radially further from the axis A than an inner element.

The figures illustrate a device 10 comprising an actuating base 11.

Preferably, the cosmetic product (shown in dotted lines in FIGS. 2 and 3) is a stick 12 of cosmetic product, and more particularly, the stick 12 of cosmetic product is a lipstick intended to be applied by rubbing, alternatively a lip care balm.

The device 10 is designed to make the cosmetic product getting out by at least one rotational movement.

The device 10 has an axis A, referred to as main axis.

The device 10 comprises at least one first element, conventionally and hereinafter referred to as guide 14. The guide 14 is particularly visible in FIGS. 1 to 3, as well as in FIG. 4.

The guide 14 primarily comprises a tubular body 16 which extends axially from a lower end 18 of the guide 14 to an upper outlet opening 20 intended to be passed through by the cosmetic product stick 12. The upper outlet opening 20 is delimited by a bevelled edge with respect to the main axis A of the device 10.

Figure 8:
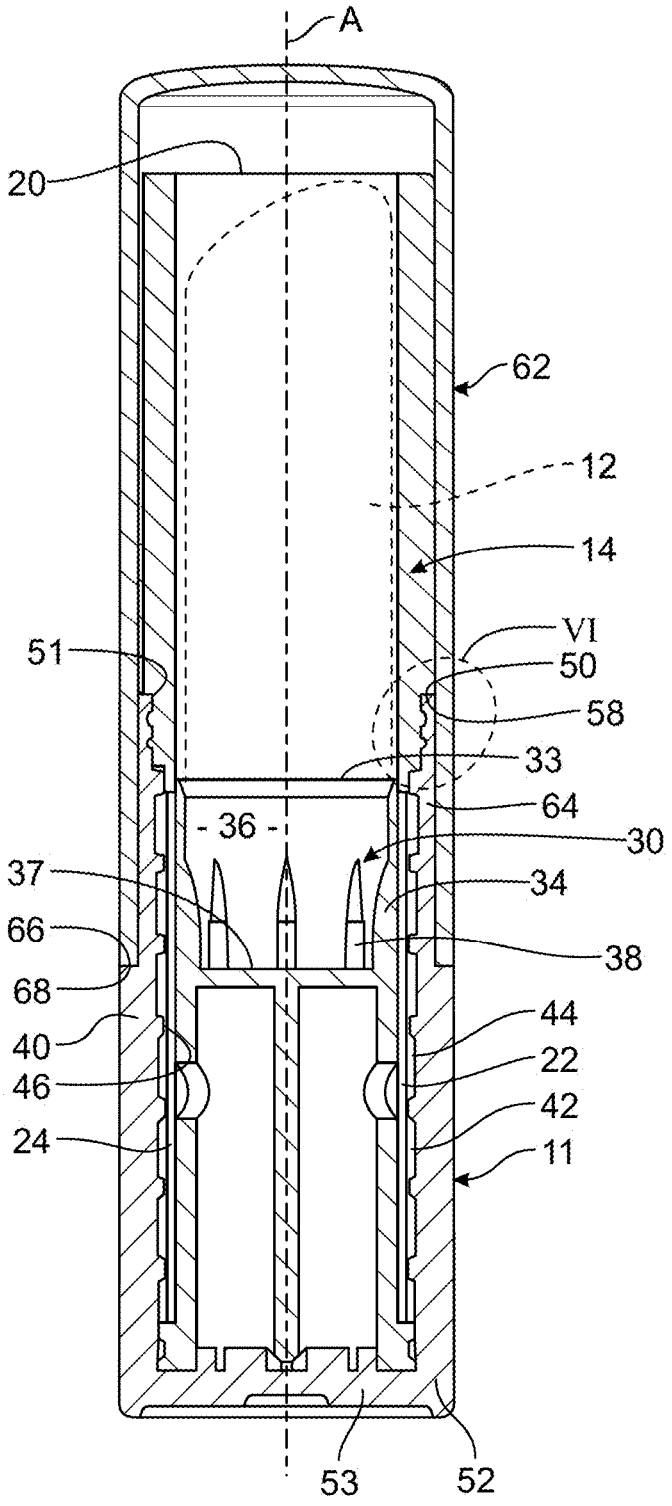
FIG. 8 is a view similar to FIG. 2 in which the upper end of the guide has an edge orthogonal to the main axis of the device.

Alternatively, as shown in FIG. 8, the upper outlet opening 20 is delimited by an edge extending in a plane orthogonal to the main axis A.

Preferably, the guide 14 comprises at least one slot passing radially through the wall of the body 16. Each slot forms a slide. Here, the guide 14 comprises a first slot 22 and a second slot 24 passing radially through the wall of the body 16. The slots 22, 24 are arranged diametrically opposite each other.

The two slots 22, 24 extend axially into the body 16 of the guide 14. The slots 22, 24 each comprise straight, parallel axial edges 25 oriented. Both slots 22 are axially closed at their upper end. Each slot 22, 24 is more particularly delimited axially towards the opening 20 by an upper edge 26. The upper edge 26 has a straight shape.

The slots 22, 24 are open in the lower end 18 of the body 16. Thus, a lower stretch of the body 16 is divided into two legs 27 by the slots 22, 24. The legs 27 can be elastically bent so that the axial edges 25 can be spaced apart.

Figure 4:
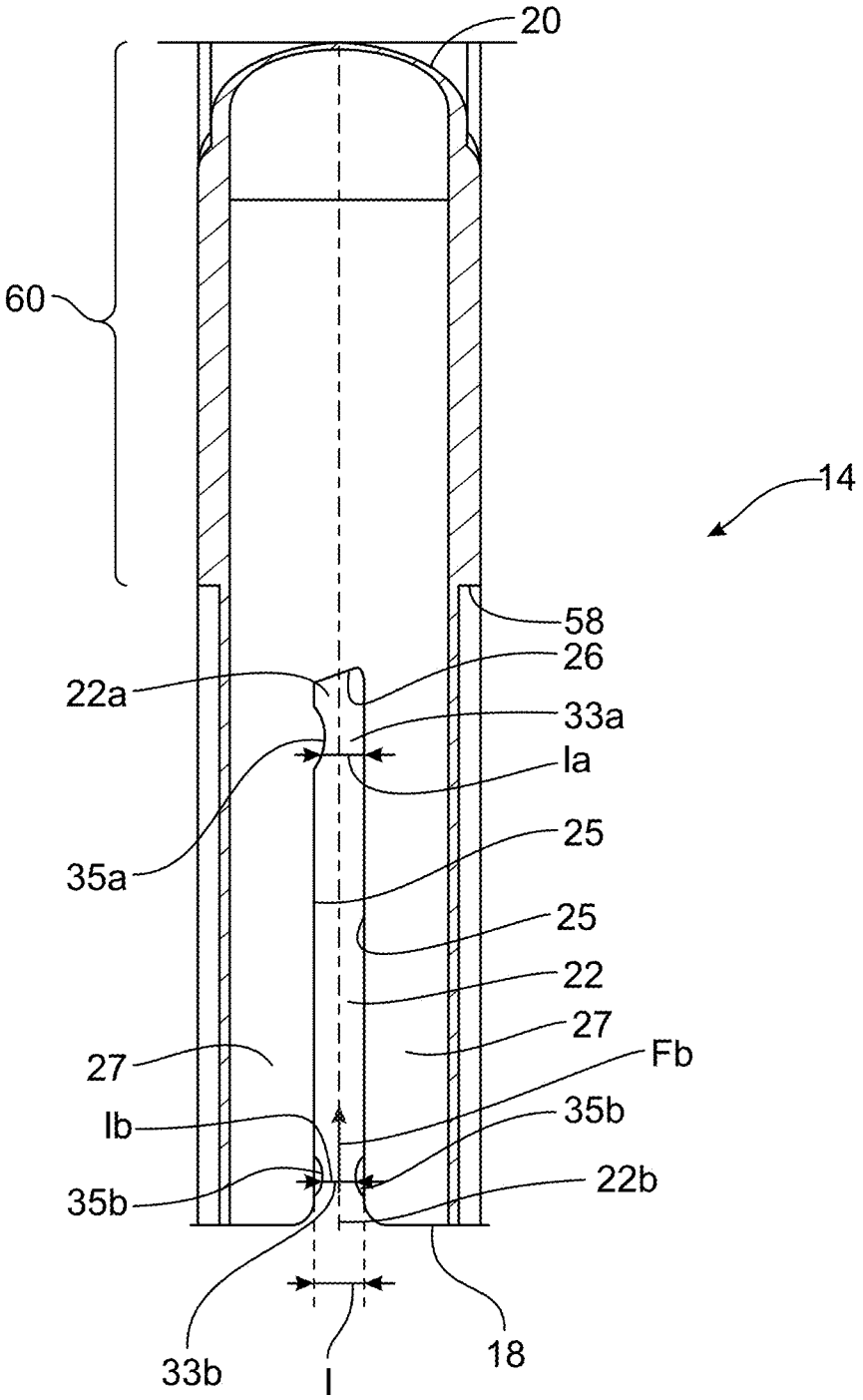
FIG. 4 is an axial cross-sectional view showing only a guide of the application device of FIG. 1.

In the unconstrained position of the legs 27, the slots 22, 24 have a constant width "I" along their entire length, as shown in FIG. 4. This width "I" is intended to allow the guidance of a cup 30.

Figure 2:
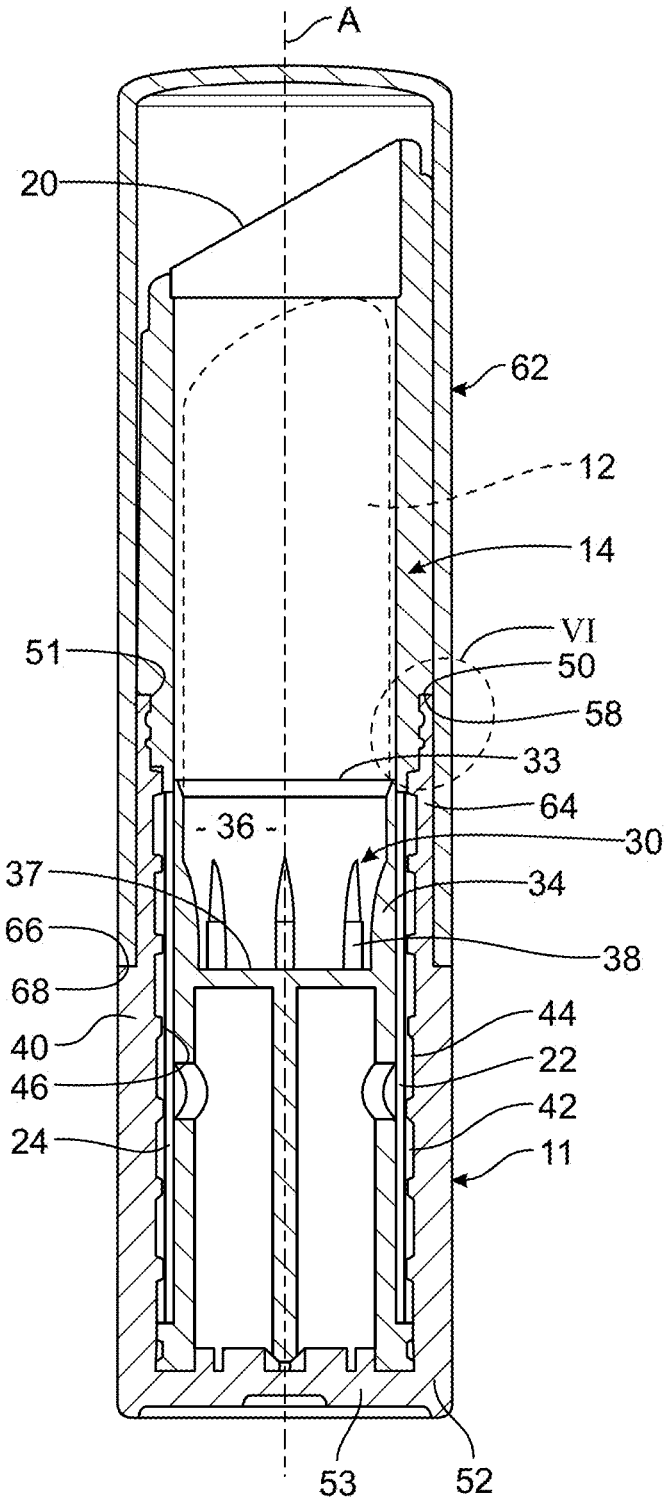
FIG. 2 is an axial cross-sectional view of the application device of FIG. 1 in a mounted state with a cup in an extreme retracted position.
Figure 3:
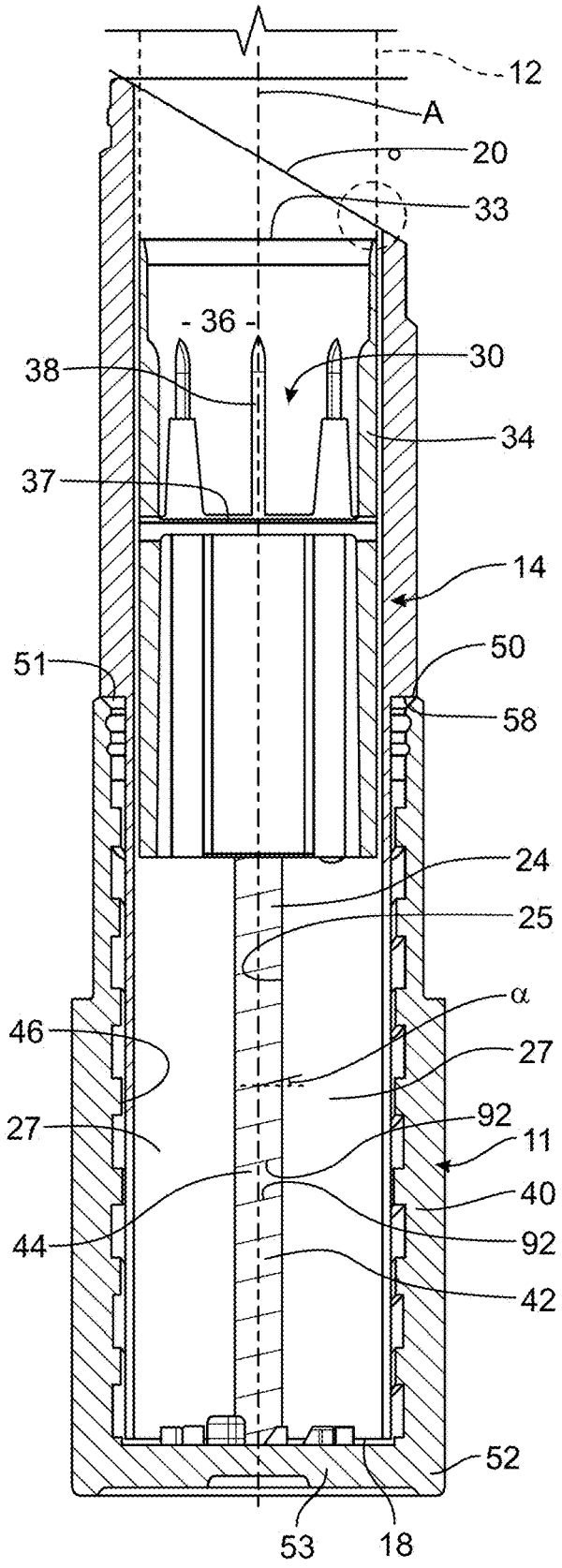
FIG. 3 is an axial cross-sectional view of the application device of FIG. 1 in a mounted state with a cup in an extreme extended position.

The device 10 comprises the cup 30 which receives the cosmetic product stick 12 as illustrated in FIGS. 2 and 3.

The cup 30 is intended to be axially slidably mounted in the guide 14 between an extreme retracted position, as shown in FIG. 2, and an extreme extended position, as shown in FIG. 3.

The extreme retracted position corresponds to a position in which the stick 12 is inside the device 10 for its protection and its storage and the cup 30 is in the position of low end-of-stroke as shown in FIG. 2. In this position, the stick 12 is surrounded and protected by the guide 14, with the free upper end of the stick 12 being located below the level of the upper opening 20.

The extreme extended position corresponds to a position in which the stick 12 is extended axially upward so that its free end extends out of the device 10 through the opening 20 and the cup 30 is in the high end-of-stroke position as shown in FIG. 3.

The cup 30 can also be in intermediate positions between its two extreme retracted and extended positions, referred to as intermediate application positions.

Figure 5:
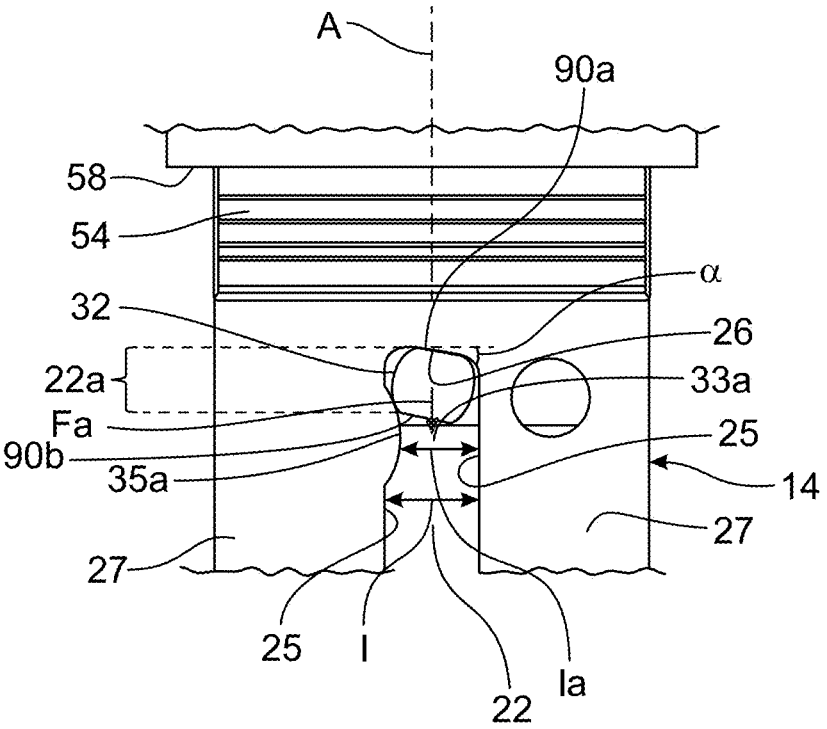
FIG. 5 is a larger scale side view showing a stretch of the guide of FIG. 4 taken at the level of an upper end of a slot for receiving a lug of the cup, with the cup being mounted in the guide and in its extreme extended position.

As shown in FIGS. 1 and 5, the cup 30 comprises at least one lug 32, preferably two lugs 32. Each lug 32 protrudes radially outwardly, said lugs 32 each being engaged in and extending through one of the slots 22, 24 of the guide 14 to pass through to extend radially outwardly beyond the external cylindrical surface of the body 16 of the guide 14.

The width "I" of each slot 22, 24 is substantially equal to the width of the associated lug 32 so as to allow the associated lug 32 to be received with a circumferential clearance allowing the axial sliding of the cup 30 relative to the guide 14 without tightening the lug 32.

As shown in FIGS. 4 and 5, the device 10 comprises means for blocking the end-of-stroke of the cup 30 in its extreme extended position. To this end, at least the first slot 22 has an upper end stretch 22*a* which has the width "I" substantially equal to the width of the lug 32, the lug 32 being housed in said upper end stretch 22*a* of the slot 22 in the extreme extended position of the cup 30, as shown in FIG. 5. The slot 22 further has a passage restriction 33*a* arranged at the lower entrance of the upper end stretch 22*a* of the slot 22.

Only the first slot 22 here includes the passage restriction 33*a*.

In an alternative embodiment of the invention, the first slot 22 and the second slot 24 each include such a passage restriction 33*a*.

The passage restriction 33*a* is here made by a projection 35*a* which extends only from one of the axial edges 25 towards the other axial edge.

Figure 7:
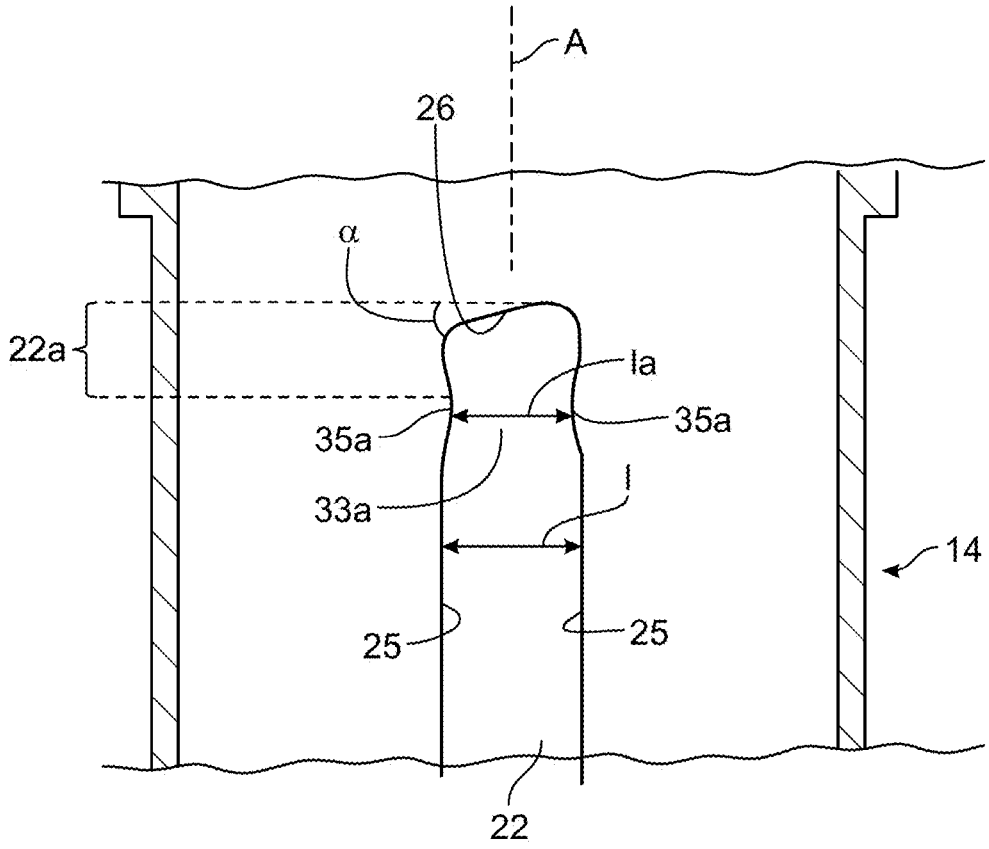
FIG. 7 is a view similar to that of FIG. 5, which represents an alternative design of the lug receiving slot.

In a variant shown in FIG. 7, the passage restriction 33*a* towards the upper end stretch 22*a* of the slot 22 is made by projections 35*a* extending from each of the opposite axial edges 25. The two projections 35*a* are arranged opposite each other in a direction orthogonal to the main "A" axis.

The width "Ia" of the slot 22 at the level of the passage restriction 33*a* is slightly less than the width of the lug 32. Thus, when it is desired to make the lug 32 overcome the passage restriction 33*a*, it is necessary to apply to the cup 30 an axial overcoming force "Fa" which is greater than the force required for its sliding along the rest of the slot 22. This effort "Fa" of overcoming must notably allow the legs 27, and therefore the edges 25, to be elastically spaced apart.

When the cup 30 occupies its extreme extended position, as long as a force greater than or equal to this axial overcoming force "Fa" has not been applied to it, the cup 30 is blocked in the extreme extended position.

To enable the edges 25 to be spaced apart automatically, the projection 35*a* has a rounded shape which cooperates with the associated lug 32 to space apart the edges 25.

The upper end stretch 22*a* also has an axial length substantially equal to the axial length of the associated lug 32. Thus, when the cup 30 occupies its extreme extended position, the lug 32 is housed in the upper end stretch 22*a* of the slot 22, the legs 27 are returned to their resting position. In this position, the projection 35*a* is preferably in contact with the lug 32. The lug 32 is thus forced by the projection 35*a* against the upper end edge 26 of the slot 22 under the effect of the elastic return force of the axial edges 25 towards each other. In this way the cup 30 is held immobile in its extreme extended position.

In addition, as shown in FIG. 4, the device 10 also comprises means for blocking the end-of-stroke of the cup 30 in its extreme retracted position. To this end, at least the first slot 22 has a lower end stretch 22*b* which has a width "I" substantially equal to the width of the lug 32, the lug 32 being housed in said lower end stretch 22*b* of the slot 22 in the extreme retracted position of the cup 30. The slot 22 further has a passage restriction 33*b* arranged at the upper entrance of the lower end stretch 22*b* of the slot 22.

The restriction 33*b* of passage towards the lower end stretch 22*b* of the slot 22 is made by projections 35*b* extending from each of the opposite axial edges 25 of the slot 22.

In an alternative, not shown, embodiment of the invention, the passage restriction is made by a projection which extends from only one of the axial edges towards the other axial edge.

The width "Ib" of the slot 22 at the level of the passage restriction 33*b* is slightly less than the width of the lug 32. Thus, when it is desired to make the lug 32 overcome the passage restriction 33*b*, it is necessary to apply to the cup 30 an axial overcoming force "Fb" which is greater than the force necessary for its sliding along the rest of the slot 22. This overcoming force "Fb" should allow the legs 27, and therefore the edges 25, to be elastically spaced apart. However, as this passage restriction 22*b* is located at the lower free end of the legs 27, the force "Fb" required to overcome it is less than the force "Fa" required to overcome the passage restriction 22*a* arranged near the upper end 22*a* of the slot 22 by lever arm effect.

The lower end stretch 22*b* also has an axial length substantially equal to the axial length of the associated lug 32. Thus, when the cup 30 occupies its extreme retracted position, the lug 32 is housed in the lower end stretch 22*b* of the slot 22, and the legs 27 are returned to their rest position. The projections 35*b* are preferably in contact with the lug 32 to immobilise the cup 30.

As illustrated in FIGS. 2 and 3, the cup 30 comprises a cylindrical wall 34 which extends axially. The wall 34 delimits a housing 36 which receives the lower portion of the stick 12. The housing 36 is open upwards by an inlet 33. The housing 36 is delimited axially downward by a bottom 37. The internal face of the cylindrical wall 34 is equipped with ribs 38 which are intended to attach the stick 12 firmly in the housing 36.

The device 10 comprises a second element, hereinafter referred to as the sheath 40. As shown here, the sheath 40 has a cylindrical shape with a main axis A.

Preferably, the sheath 40 internally comprises at least one groove receiving the free end of an associated lug 32 of the cup 30. The sheath 40 here comprises two diametrically opposed grooves 42, 44, with which the free ends of the lugs 32 of the cup 30 cooperate in operation. The sheath 40 comprises an internal wall 46 provided with said helical grooves 42, 44. The grooves 42, 44, have a helical shape. Thus, each groove is delimited by two walls 92, upper and lower, having a slope forming a constant helix angle "α" with a radial plane.

Furthermore, the two lugs 32 of the cup 30 are generally rounded and advantageously have an upper flattened area 90*a* and a lower flattened area 90*b*. The flattened areas 90*a*,

90*b* are parallel. They are configured to cooperate with the walls 92 of the helical grooves 42, 44 of the sheath 40, as shown in FIG. 5. In particular, the flattened areas 90*a*, 90*b* have the same slope as the walls 92. The flattened areas 90*a*, 90*b* thus have an inclination forming the same angle "α" of inclination with a radial plane as that of the walls 92 of the helical grooves 42, 44.

In other words, each lug 32 extends in a direction similar to the direction of the helical groove 42, 44 in which it is engaged.

This particular shape of the lugs 32 is adapted to the shape of the helical grooves 42, 44 so as to facilitate their sliding and so that they house therein without getting out even if a user forces the rotation. This reduces the risk of damaging the cup 30.

In addition, the flattened areas 90*a*, 90*b* also extend through the associated slot 22, 24. As previously explained, when the cup 30 occupies its extreme extended position, the lug 32 is pressed against the upper end edge 26 of the associated slot 22, 24.

However, due to the inclination of the upper flattened area 90*a*, if the upper edge were perpendicular to the axial direction, the lug 32 would only be in contact with the upper edge at a point on which it would exert an enormous pressure. This could cause a plastic deformation of the lug and/or the upper edge, creating a clearance that would allow the lug to move relative to the slot. Furthermore, in such an arrangement, the single-point contact of each lug with the upper edge of the associated slot would risk causing a tilting of the cup about an axis passing through the two contact points.

In order for the cup 30 to be stable in its extreme extended position, the upper edge 26 of each slot 22, 24 has the same angle "α" of inclination with respect to a radial plane as the upper flattened area 90*a* of the lug 32 so that in the extreme extended position, the lug 32 bears against the upper edge 26 over the entire width of the upper flattened area 90*a*. Thus, the tightening force of the lug 32 against the upper edge 26 is distributed over the entire width of the lug 32, as shown in FIG. 5. The cup 30 thus occupies a stable and well-defined extreme extended position relative to the guide 14.

The sheath 40 is integrally made with the base 11 of the device 10. The sheath 40 comprises an upper edge 50 located at its upper axial end and a lower edge 52 located at its lower axial end, respectively, said edges 50 and 52 being circumferentially continuous. The upper edge 50 delimits an upper opening 51 of the sheath 40. The base 11 also comprises a radial bottom 53 which extends from the lower edge 52 to completely close the sheath 40 downwards. The sheath 40 and the bottom 53 are integrally formed.

The sheath 40 is intended to be snap-fitted onto the guide 14 to obtain, after mounting, the device 10 shown in particular in FIGS. 2 and 3. In the mounted position, the opening 20 of the guide 14 is arranged above the upper edge 50 of the sheath 40.

The guide 14 is mounted in rotation in the sheath 40 around the main axis "A". The guide 14 is thus received concentrically inside the sheath 40. To this end, the body 16 of the guide 14 has an external diameter substantially equal to the internal diameter of the sheath 40, with a radial clearance allowing their relative rotation.

Figure 6:
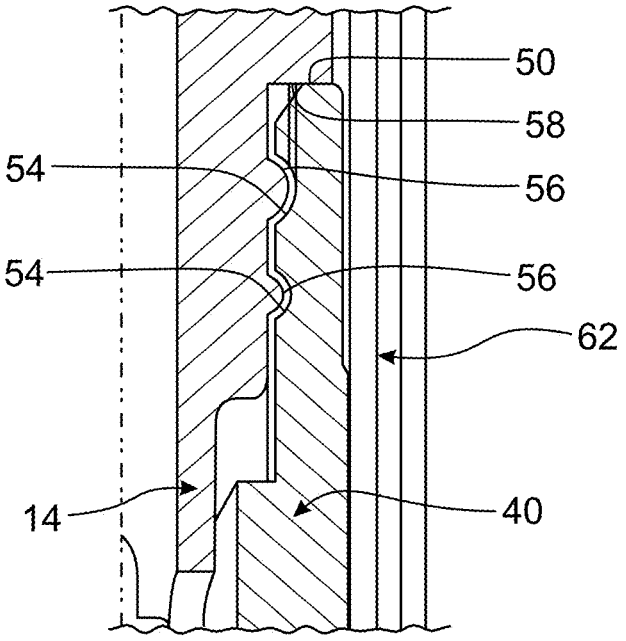
FIG. 6 is a larger scale view of the detail surrounded by the circle "VI" in FIG. 2 which shows means for axially attaching the guide to a sheath of the device.

In the embodiment shown in detail in FIG. 6, the elastic snap-fit is here obtained, in a non-limiting manner, by at least one annular gorge 54 (here two gorges) which extends in hollow from an upper segment of the inner face of the sheath 40. A bead 56 associated with each gorge 54 extends radially in projection from the external face of the body 16 of the guide 14. The bead 56 is intended to be snap-fitted elastically into the gorge 54 of the sheath 40 when the body 16 of the guide 14 is inserted axially, from top to bottom, through the upper opening 51 of the sheath 40. This mounting by means of beads 56 and gorges 54 allows the guide 14 to be axially attached with respect to the sheath 40 while allowing them to rotate with respect to each other about the axis "A".

For a precise axial positioning of the sheath 40 with respect to the guide 14, a positioning face of the guide 14 is intended to abut axially against a positioning face facing the sheath. In the example shown in the figures, the guide 14 has an upper stretch 60, located axially above the legs 27, which has a shoulder 58 radially outwards from the legs 27. This shoulder 58 bears axially against the upper edge 50 of the sheath 40 when the guide 14 is mounted in the sheath 40. The shoulder 58 of the guide 14 thus forms the positioning face of the guide 14 while the upper edge 50 of the sheath 40 forms the positioning face of the sheath 40.

In such a device 10, the rotation of the guide 14 by means of its upper end stretch with respect to the base 11 comprising the sheath 40 causes an axial movement of the cup 30, more precisely an upward movement or a downward movement of the cup 30 depending on the rotation orientation. When the cup 30 is in its extreme extended position, the cup 30 here extends fully into the guide 14, as shown in FIG. 3.

The stick 12 of cosmetic product displaces axially with the cup 30 between the extreme extended position and the extreme retracted position.

As illustrated in FIG. 2, when the cup 30 is in its extreme retracted position, it is preferable to be able to close the device 10 by means of a cover 62 in order to avoid polluting or damaging the cosmetic product stick. In this respect, the removable cover 62 is intended to be attached directly to the base 11 comprising the sheath 40 when the device 10 is not in use.

According to one example of embodiment, the sheath 40 has an upper end stretch 64 with means on its external wall for attaching the cover 62, for example by friction. More particularly, the sheath 40 has an upwardly facing shoulder face 66 against which an annular lower end edge 68 of the cover 62 is intended to abut in the mounted position.

The guide 14, the cup 30, the base 11 and the cover 62 are advantageously made of plastic.

Preferably, the guide 14, the cup 30, the base 11 and the cover 62 are made of an identical plastic material.

The plastic material may be selected from polypropylene (PP), polyethylene terephthalate (PET), recycled polyethylene terephthalate (R-PET), thermoplastic elastomer (TPE), polyethylene (PE), such as the low density polyethylene (LDPE) and/or the high density polyethylene (HDPE), a composite material, a post-consumer recycled (PCR) material and/or the like.

These include in particular plastic material with a hardness of between 70 shore A and 90 shore D.

Preferably, it is polypropylene, whether recycled or not.

At least the guide 14, the base 11 and the cover 62 are made of 100% polypropylene.

According to a first example, the cup 30 is made of 100% polypropylene.

Thus, advantageously, all components of the device 10 are made of polypropylene.

Alternatively, the cup 30 is made of a plastic material formed by a blend comprising a fraction of polypropylene, for example at least 80% polypropylene (by weight). The remainder of the blend is, for example, polyethylene. Such a mixture makes it possible, for example, to obtain a plastic material that is recyclable, has good rigidity, and has a fairly high operating torque without the cup lugs slipping out of the helical groove.

For example, the plastic material is formed by a blend of at least 80% polypropylene (PP), with the remainder of the blend being formed of low density polyethylene (LDPE). According to various examples, the plastic material is formed by a mixture of:

80% PP and 20% LDPE, or
85% PP and 15% LDPE, or
90% PP and 10% LDPE, or
95% PP and 5% LDPE.

Thus, the entire device 10 comprises essentially polypropylene mixed with less than 10% polyethylene (by weight relative to the polypropylene), which allows the entire device 10 to be recycled in a process intended for polypropylene.

Alternatively, LDPE may be replaced with high density polyethylene (HDPE).

Alternatively, the cup 30 is made of polyethylene (PE) while the guide 14, the base 11 and the cover 62 are made of polypropylene (PP). Thus, the entire device 10 comprises essentially polypropylene mixed with less than 10% polyethylene (by weight relative to polypropylene).

The plastic components can be easily obtained by injection moulding and result in a lightweight device 10.

Furthermore, the use of plastic materials, in particular similar plastic materials for the entire device 10 allows to facilitate the recycling. In particular, the polypropylene is a plastic materials whose recycling cycle is well known.

The force "Fa" to overcome the upper restriction 33*a* is predetermined according to the material of which the device 10 is made. In particular, it must be high enough to allow the cup 30 to be effectively blocked in its extreme extended position during its transport and during the packaging of the stick 12. But it must be low enough not to damage the components, especially the helical groove 42, 44.

When the device is mounted, the cup 30 is inserted axially into the guide 14 through its lower end 18. The lugs 32 are each inserted into the associated slot 22, 24 with its lower open end.

Then, the base 11 comprising the sheath 40 receives the guide 14 thus equipped with the cup 30 through its upper opening 51 until the beads 56 snap-fit into the gorges 54. The shoulder 58 of the guide 14 is then in abutment against the upper edge 50 of the sheath 40. The lugs 32 of the cup 30 are each received in an associated helical groove 42, 44.

At this time, the cup 30 does not yet comprise the cosmetic product stick 12. In preparation for receiving the stick 12, the cup 30 is controlled to its extreme extended position in which it is stably immobilised by the projection 25*a* and by the upper edge 26 of each slot 22, 24 in cooperation with the associated lug 32.

Generally, the assembled device 10 is transported, with the cup 30 blocked in its extreme extended position, to the packaging site of the stick 12. The assembly site of the device 10 and the packaging site of the stick 12 may be located at very great distances from each other, for example several tens or hundreds of kilometres. The force "Fa" to overcome the upper restriction 33*a* is generally defined so that the devices 10 can be subjected to normal vibrations or shocks during the transport without the cup 30 leaving its extreme extended position.

The axial position of the bottom 37 of the cup 30 is then precisely determined in relation to the bottom 53 of the base. Indeed, the axial position of the bottom 37 of the cup 30 with respect to the guide 14 is determined by the distance between the lugs 32 and the bottom 37 of the cup 30. The axial position of the lugs 32 relative to the shoulder face 58 of the guide is determined by the distance between the upper edges 26 of the slots 22, 24 and the shoulder 58 of the guide. The axial position of the shoulder face 58 of the guide 14 is determined by the axial distance between the upper edge 50 of the sheath and the bottom 53 of the base 11. Thus, the rib string for determining the axial position of the bottom 37 of the cup 30 is reduced to three values, which allows the axial positioning tolerance to be reduced, for example to 0.2 mm.

This allows the pre-moulded cosmetic product stick 12 to be inserted into the cup correctly, ensuring a good hold and avoiding its degradation. The axial force exerted by the stick 12 on the cup 30 during its insertion is less than the axial force required to make the lugs 32 overcome the upper passage restriction 33*a*.

The invention claimed is:

1. A device for applying a cosmetic product stick, having a main axis (A), said device comprising:

a cup for receiving the stick and comprising at least one radial lug;

at least one guide comprising a tubular body which comprises an upper opening through which the stick gets out, in which the cup is mounted so as to slide axially, the guide comprising at least one axial slot extending from a bottom of the guide, which is passed through by the at least one associated lug of the cup, the slot being delimited by a rectilinear upper edge;

a tubular sheath in which the tubular body of the guide is mounted in rotation, the tubular sheath comprising internally at least one helical groove for receiving the at least one lug of the cup, the rotation of the guide with respect to the tubular sheath causing an axial movement of the cup between an extreme extended position in the vicinity of the upper opening in which the lug is in abutment against the upper edge of the slot and an extreme retracted position;

wherein the tubular sheath is integrally made with a base of the device to which a removable cover is intended to be directly attached, the tubular sheath, the base and the guide being made of polypropylene, wherein the at least one slot is open axially in a direction opposite the upper opening.

2. The device according to claim 1, wherein the cup is made of 100% polypropylene.

3. The device according to claim 1, wherein the cup is formed from a blend comprising at least 80% polypropylene, the remainder of the blend being formed from low density polyethylene.

4. The device according to claim 1, wherein the at least one lug has an upper flattened area.

5. The device according to claim 4, wherein the lug comprises a lower flattened area parallel to the upper flattened area, the lower flattened area cooperating with a lower wall of the associated helical groove of the sheath.

6. The device according to claim 1, wherein the upper edge of the at least one slot is inclined with respect to a radial plane orthogonal to the main axis (A).

7. The device according to the claim 6, wherein the helical groove has a constant angle ($\alpha$) of inclination, the upper flattened area of the lug having the same angle ($\alpha$) of inclination as the helical groove and cooperating with an upper wall of said helical groove, the upper edge of the at least one slot having the same angle ($\alpha$) of inclination as the upper flattened area of the lug so that, in the extreme extended position, the lug bears against the upper edge over the entire width of the upper flattened area.

8. The device according to claim 1, wherein the at least one slot has an upper end stretch which has a width (I) substantially equal to a width of the lug, the lug being housed in said upper end stretch of the at least one slot in the extreme extended position of the cup.

9. The device according to claim 8, wherein the at least one slot has a passage restriction arranged at a lower entrance of the upper end stretch of said slot.

10. The device according to the claim 9, wherein the at least one slot is delimited in a width orientation by two axial edges, the restriction of passage being made by at least one projection made in the one and/or the other of the axial edges.

11. The device according to claim 10, wherein passage of the lug through the restriction of passage is achieved by elastically spacing apart the axial edges of the at least one slot.

12. The device according to claim 11, wherein, when the cup occupies its extreme extended position, the lug is tightened axially between the upper edge of the at least one slot and the at least one projection by an elastic return force of the axial edges, the cup thus being blocked in its extreme extended position as long as an axial force greater than a force for overcoming the restriction of passage is not applied to the cup.

13. The device according to claim 1, wherein there are two at least one slot which are open in a lower end of the body, a lower stretch of the body being therefore divided into two legs by the slots.

14. The device according to claim 13, wherein the guide has an upper stretch, located axially above the legs, which has a shoulder radially outwards with respect to the legs, this shoulder bearing axially against an upper edge of the sheath.

15. The device according to claim 1, wherein the upper opening of the guide is delimited by a bevelled edge with respect to the main axis (A) of the device.

16. The device according claim 1, wherein the upper opening of the guide is delimited by an edge extending in a plane orthogonal to the main axis (A).

17. The device according to claim 1, wherein the cover is made of polypropylene.

* * * * *